US008870721B2

(12) United States Patent
Casadei

(10) Patent No.: US 8,870,721 B2
(45) Date of Patent: Oct. 28, 2014

(54) GYMNASTIC MACHINE

(75) Inventor: Marco Casadei, Montecolombo (IT)

(73) Assignee: Technogym S.p.A., Gambettola (FC) (IT)

( * ) Notice: Subject to any disclaimer, the term of this patent is extended or adjusted under 35 U.S.C. 154(b) by 238 days.

(21) Appl. No.: 13/451,820

(22) Filed: Apr. 20, 2012

(65) Prior Publication Data

US 2012/0270707 A1 Oct. 25, 2012

(30) Foreign Application Priority Data

Apr. 21, 2011 (IT) ..... RA2011A0014

(51) Int. Cl.
*A63B 21/062* (2006.01)
*A63B 23/12* (2006.01)
*A63B 21/00* (2006.01)

(52) U.S. Cl.
CPC ..... *A63B 23/12* (2013.01); *A63B 23/1254* (2013.01); *A63B 21/00* (2013.01); *A63B 2210/50* (2013.01); *A63B 21/154* (2013.01); *A63B 21/062* (2013.01)
USPC ..... 482/98; 482/100; 482/99

(58) Field of Classification Search
CPC ..... A63B 21/154; A63B 21/0552; A63B 21/072; A63B 21/0615; A63B 21/062
USPC ..... 482/92–94, 97–103
See application file for complete search history.

(56) References Cited

U.S. PATENT DOCUMENTS

| | | | | |
|---|---|---|---|---|
| 5,304,107 | A * | 4/1994 | Jones | 482/98 |
| 6,394,936 | B1 | 5/2002 | Voris | |
| 6,579,213 | B1 | 6/2003 | Webber | |
| 8,075,459 | B2 * | 12/2011 | Axelsson | 482/100 |
| 2003/0092543 | A1 * | 5/2003 | Giannelli | 482/100 |
| 2006/0240956 | A1 | 10/2006 | Piane, Jr. | |

OTHER PUBLICATIONS

Italian Search Report and Written Opinion dated Dec. 8, 2011.

* cited by examiner

*Primary Examiner* — Loan H Thanh
*Assistant Examiner* — Megan Anderson
(74) *Attorney, Agent, or Firm* — Abelman, Frayne & Schwab

(57) ABSTRACT

Functional group (1) for a gymnastic machine (100) provided with a frame (110) supporting a load group (120) usable for executing a gymnastic exercise; the machine (1) comprising an actuating group (130) provided with at least one user interface (132) carried movable by the frame (110) to exchange power with the load group (120); a modular transmission member (10) being arranged between each user interface (132) and the load group (120) to exchange power between these latter so as to facilitate the assembling and disassembling of the frame (110).

10 Claims, 3 Drawing Sheets

GYMNASTIC MACHINE

CROSS REFERENCE TO RELATED APPLICATIONS

This application claims priority to Italian patent application No. RA2011A000014, filed Apr. 21, 2011.

FIELD OF THE INVENTION

The present invention relates to a gymnastic machine. In particular, the present invention relates to a gymnastic machine provided with a load group and an actuating group connected with each other through a functional group designed to facilitate assembling operations.

BACKGROUND OF THE INVENTION

In the field of gymnastic equipment the construction of weight stack machines is well known, wherein a load group is coupled to an actuating group through at least one implement shaped to be usable to exchange muscular power with the load group to execute a training exercise for at least one muscular region. Each gymnastic machine is designed for a given field of use according to the desired type of training and to the involved muscular region. To this end machines are well known provided with an actuating group comprising at least one lever, which is pivoted on a frame, is provided with at least one gymnastic implement and is connected with the load through at least one flexible member.

Due to the need to couple actuating groups for executing training exercises involving different muscular groups, the designers have developed load groups specifically modelled on the actuating group and have provided given transmission groups and return members arranged on paths constrained by the frame dimensions and bulk. Usually, the load groups comprise a plurality of bricks supported by the frame in a freely slidable manner through vertical guides. In this way each machine presents a frame and an actuating group designed and dimensioned in a tailored manner, and each machine of a line represents therefore a "world" in itself. It is easily understood that this entails costs that can be compensated only selling sufficient quantities of each model of machine. On the other hand, this choice leads to an increased number of product codes for each machine and to highly complex bills of materials for each line of machines. Furthermore, an extremely large warehouse for the spare parts is required, and the management thereof is particularly onerous and even more difficult to be justified. It is easily understood that the complexity of the bill of materials of each machine of a line of machines is a serious problem, due to the costs connected with the high number of spare parts in the warehouse, clearly contrasting with the current need to limit the production and service costs as much as possible. This is a particular critical aspect for companies comprising a network of branches and/or subcontractors and distributors worldwide. As it is clearly apparent, to solve the above mentioned problem it is necessary to redesign the functional relations between the groups composing each type of machine of a same line, such as, although without limitation, the actuating group, the load group and the transmission group.

In view of the above description, the problem of the complex structure of the gymnastic machines, and in particular of the mechanical ones, and therefore of the respective component groups, is currently unsolved, and represents an interesting challenge for the applicant, desiring to reduce the production costs, and therefore the final cost of its gymnastic machines and of the customer service, increasing quality, reliability and easiness of use of its products and, obviously, its market share.

In view of the situation described above, it would be desirable to have available a gymnastic machine provided with respective functional groups, and in particular, although without limitation, those of the mechanical type, which, in addition to enabling to limit and possibly to overcome the typical drawbacks of the prior art illustrated above, could define a new standard for these types of machines. In particular, using the teachings of the present invention it would be desirable to provide gymnastic machines provided with substantially identical and interchangeable functional groups, in order to simplify the production phases of each machine of a given line. It is easily understood that, in detail, this allows to simplify the management of the bills of materials of the machines of the same line and of the warehouse for the components; to facilitate the assembling, transport, and construction of each single machine, to improve the fluency of the resistant load and the safety in use, to delocalize the construction of components of the machines of a line ensuring interchangeability of the components, and to obtain scale economies.

SUMMARY OF THE PRESENT INVENTION

The present invention relates to a gymnastic machine. In particular, the present invention relates to a gymnastic machine provided with a load group and an actuating group connected with each other through a functional group designed to facilitate assembling operations.

The object of the present invention is to provide teachings for producing a functional group validly usable in a gymnastic machine in combination with a load group and an actuating group to facilitate the transport, the purchasing of the components, the assembling and, synthesizing, the installation of the machine.

According to the present invention a functional group is provided, whose main characteristics will be described in at least one of the appended claims.

A further object of the present invention is to provide a gymnastic machine provided with respective functional groups usable to solve the disadvantages described above and to satisfy a plurality of requirements that to date have still not been addressed, and therefore suitable to represent a new and original source of economic interest, capable of modifying the current market of the gymnastic machines and of the components thereof.

According to the present invention, a gymnastic machine is produced, provided with respective functional groups, whose main characteristics will be described in at least one of the appended claims.

BRIEF DESCRIPTION OF DRAWINGS

Further characteristics and advantages of the functional group for a gymnastic machine according to the present invention will be more apparent from the description below, set forth with reference to the accompanying drawings, which illustrate at least one non-limiting example of embodiment, in which identical or corresponding parts are identified by the same reference numbers. In particular.

DETAILED DESCRIPTION OF THE PRESENT INVENTION

Figure 1:
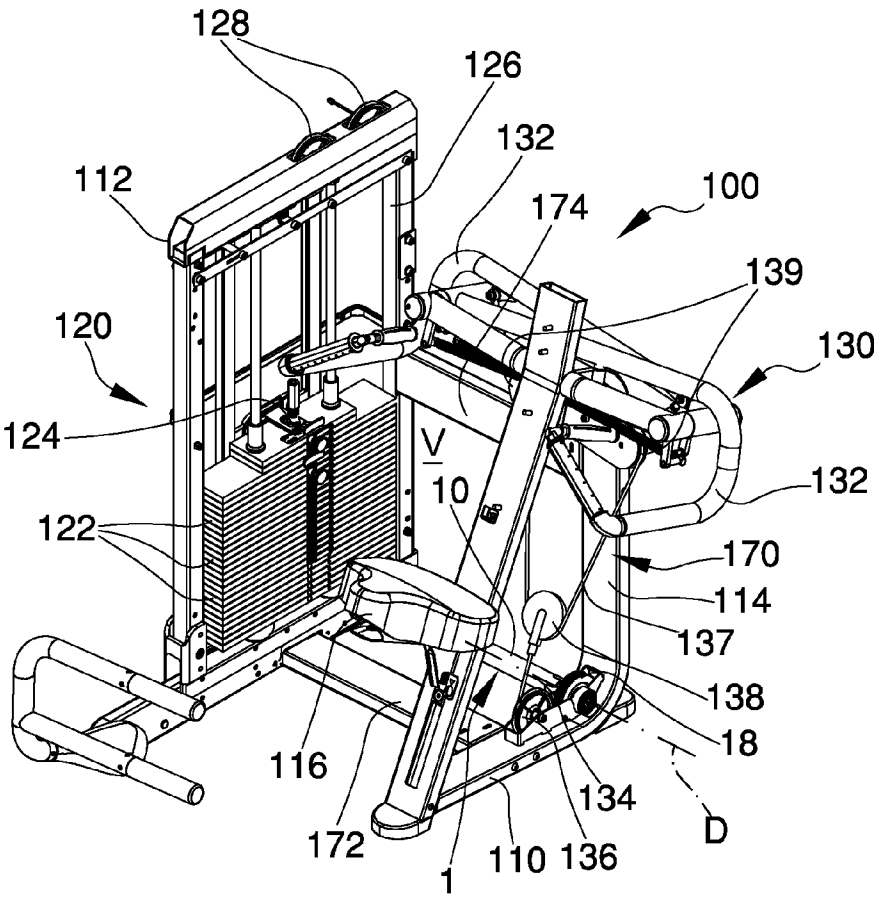
FIG. 1 is a front schematic perspective view of a first preferred embodiment of a gymnastic machine provided with a functional group according to the present invention.

In FIG. 1, number 1 indicates in its entirety a functional group 1 for a gymnastic machine 100 provided with a frame 110 supporting a load group 120 usable to execute a gymnastic exercise. The machine 1 comprises an actuating group 130 different than the load group and provided with at least one user interface 132 carried movable by the frame 110 to exchange power with the load group 120. The functional group 1 comprises a modular transmission member 10, better shown in FIG. 4, arranged between the user interface 132 and the load group 120 to exchange power between these latter so as to facilitate the assembling and disassembling phases of the frame 110 and, definitely, of the machine 100. This transmission member 10 comprises a torsion shaft 10 extending along a given direction D that in FIG. 1 is arranged horizontally between the load group 120 and the actuating group 130. As used herein, the term "torsion shaft" is equivalent to "torsion bar" and both terms are used interchangeably below.

The load group 120 is provided with a plurality of bricks 122 put over one another along a given direction oriented in a given manner relative to the given direction D. In particular, in FIG. 1 the direction along which the bricks 122 are stacked up is transverse to the given direction D, without however limiting the protective scope of the present invention. The load group 120 furthermore comprises a rod 124 passing transversally through the bricks 122 to collect them selectively through a known transverse pin. This rod 124 is longitudinally movable through a first cable 126 wound around a plurality of second pulleys 128 carried by the frame 110 to move the bricks 122 along the given direction D.

With reference to FIG. 1 again, the actuating group 130 comprises a second cable 134 wound around at least one first pulley 136 carried by the frame 110.

Figure 4:
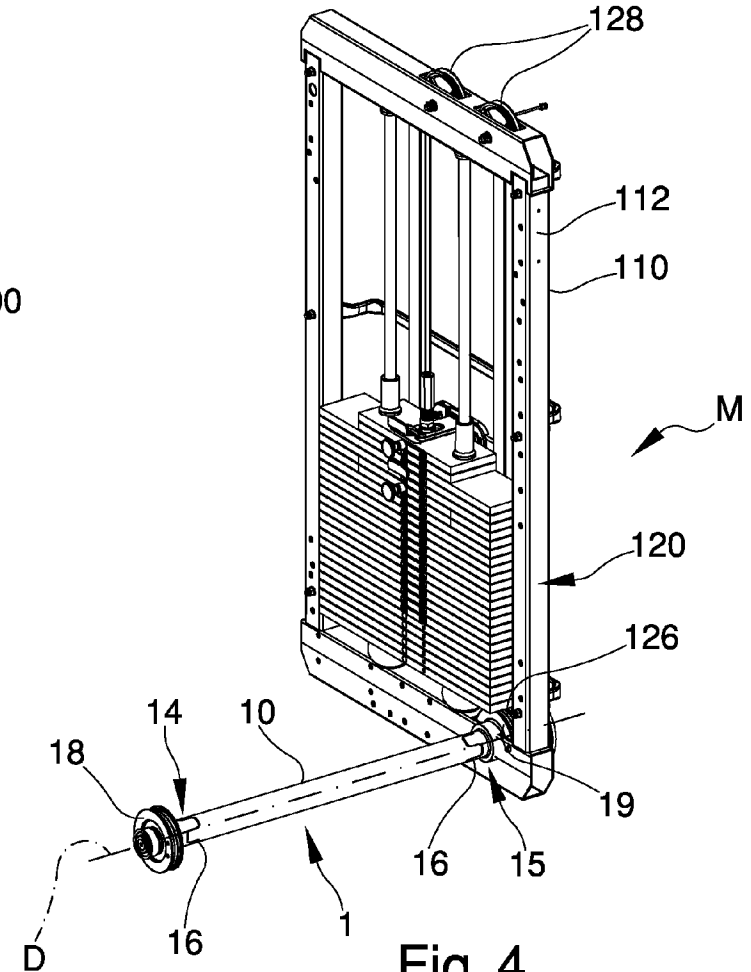
FIG. 4 shows a portion of FIG. 2, in enlarged scale and with some parts removed for the sake of clarity, from a raised viewpoint.
Figure 5:
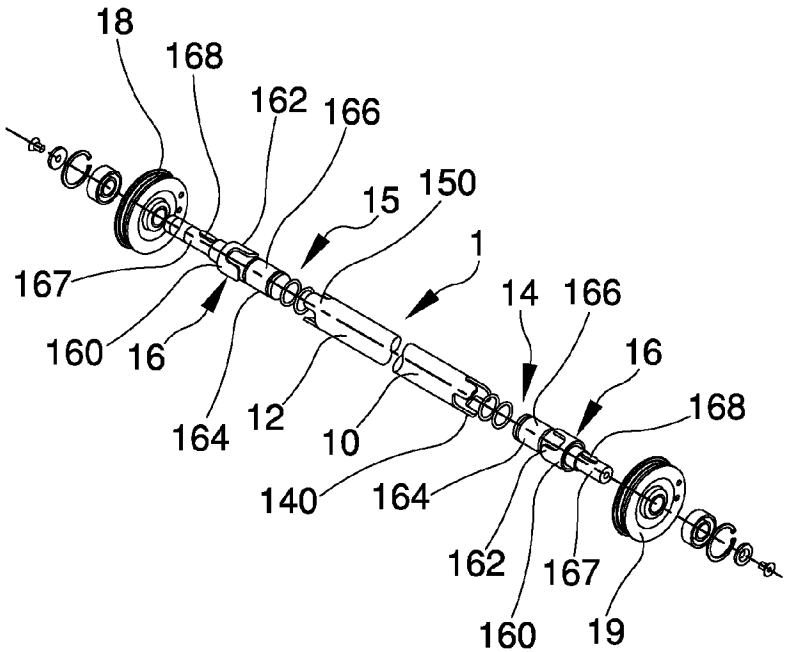
FIG. 5 is an exploded view of a detail extracted from FIG. 4, in enlarged scale and with some parts removed for the sake of clarity.

With particular reference to FIGS. 4 and 5, the torsion shaft 10 is modular and comprises a central portion 12 axially delimited by two substantially hollow lateral portions 14 and 15, each of which supports a drum 18/19 through the interposition of a respective mechanical connecting device 16, through which the central portion 12 is connected with the frame 110 in an axially fixed and angularly rotatable manner to transmit a torque. With reference to FIG. 5, each lateral portion 14/15 of the lateral portion 12 presents an end portion 140/150 which is substantially fork-shaped, and each connecting device 16 comprises a removable head 160 provided with a coupling member 162 shaped like a fork, in a substantially identical manner to the corresponding end portion 140/150, to shape-couple and allow the exchange of a torque through the central portion 12 in an angularly fixed manner. Each coupling member 162 comprises, and is crossed by, a cylindrical shank 164 presenting an inner portion 166, suitable to engage a respective lateral portion 14/15, and an outer portion 167, provided with a seat for the respective drum 18/19 and with a respective keying member 168. In view of the above description, each connecting device 16 comprises a pair of substantially identical mechanical coupling elements, and in particular a lateral portion 14/15 and the corresponding coupling member 162 of substantially conjugated shape, substantially fork-shaped and longitudinally interpenetrated directly to transmit, in use, torque stresses between the at least one interface 132 and the load group 120. In view of the above description, the functional group 1 is, to all intents and purposes, a torsion transmission group.

Figure 3:
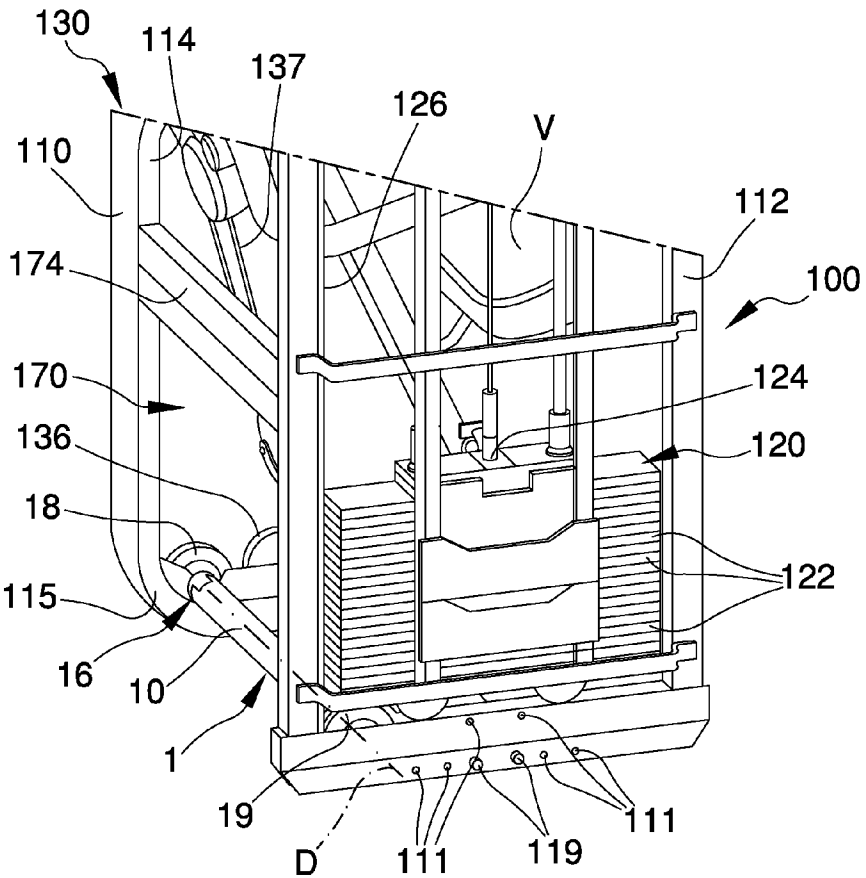
FIG. 3 is a schematic perspective view of a portion extracted from FIG. 1, in enlarged scale and with some parts removed for the sake of clarity.

The drum 18 corresponding to the actuating group 130 is associated with a base portion of the frame 110 and, as it is shown in FIG. 3, is contained inside the lower elbow of the corresponding structural portion of the frame 110.

Figure 2:
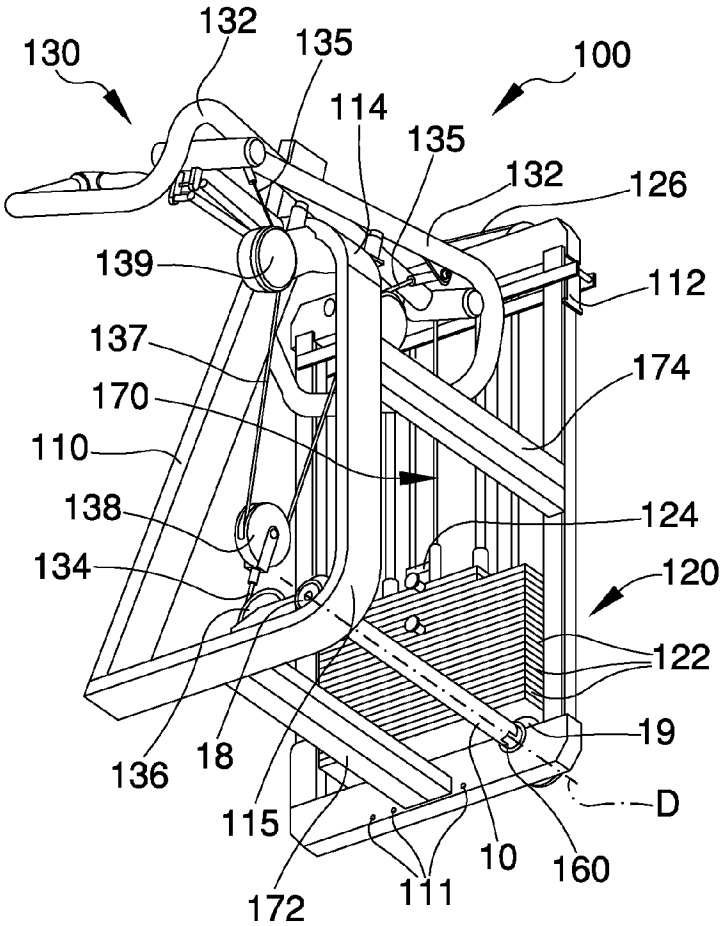
FIG. 2 is a back schematic perspective view of FIG. 1 with some parts removed for the sake of clarity.

With reference to FIGS. 3 and 4, it should be noted that the frame 110 presents a plurality of holes 111 for threaded connections 119, known and shown only in FIG. 3, through which it can be composed at will using connecting bars, as it will be better explained below. In particular, with reference to FIGS. 1-3, the frame 110 presents a first bearing portion 112 designed to support the load group 120, and a second bearing portion 114 connected with the first bearing portion 112, as it will be better described below, and designed to support the actuating group 130. In particular, as it is clearly apparent from FIG. 1, the machine 100 presents a pair of user interfaces 132, each of which is actuated through a lever shaped and pivoted, at the rear, on the second bearing portion 114 in FIG. 1. The frame 110 furthermore comprises a coupling unit 170 suitable stably to connect the first bearing portion 112 and the second bearing portion 114. This coupling unit 170 comprises a base bar 172 and an intermediate bar 174, which are arranged between the first bearing portion 112 and the second bearing portion 114, parallel to the shaft 10 and transversally to both the first bearing portion 112 and the second bearing portion 114. In particular, with reference to FIGS. 1 and 2, it should be noted that the base bar 172 delimits the frame 110 at the bottom and is arranged between base portions of the first bearing portion 112 and of the second bearing portion 114 of the frame 110. The second bar 174 is arranged in intermediate position for the load group 120; the base rod 172 is arranged adjacent to the shaft 10 and the second portion 114 is designed to carry the drum 18 at a respective elbow 115 and to position the shaft 10 at a base height for the frame 110 so as to maximise a free volume V for training.

It should be noted that the same result can be obtained by using a differently shaped torsion shaft/bar, and Cardan joints instead of the connecting devices 16 described above, even if the production costs would be significantly higher and, due to the type of application, substantially prohibitive for many market segments. On the other hand, this would allow to couple the first bearing portion 112 and the second bearing portion 114 paying less attention to the definition of the angle between the axes of the drums 18 and 19 that, in the case in question, are substantially coaxial due to the rigidity of the described connection. When the central portion 12 is telescopic, a particularly flexible mechanical member (a transmission group particularly flexible to be used) can be provided, that can be easily adapted to gymnastic machines of different configuration, wherein the first and the second bearing portions 112 and 114 are arranged at will and at distances definable at will also during installation, according to the users' needs and/or based upon the available spaces. The possibility of adjusting at will the distance between the connecting devices 16 can be maintained by realizing the connection between each coupling member 162 and the corresponding shank axially adjustable, for instance of the threaded type. This allows to vary finely the distance between the drums 18 and 19 at will, according to multiples of a step of the corresponding threading. Obviously, the fork-shaped portions of the portions 14/15 and of the corresponding coupling member 162 must present sufficient longitudinal extension to balance the change in overall longitudinal extension of the torsion shaft 10.

With reference to FIG. 1, the second portion 114 supports a pair of interfaces 132 symmetrically pivoted relative to a median plane arranged transversally to the shaft 10. The first portion 112 carries the corresponding drum 19 at opposite side from the second bearing portion 114. Furthermore, the actuating group 130 comprises a third cable 137 provided with respective ends 135, each of which is integrally connected with one of the interfaces 132. The second cable 134 presents a respective end with which a floating pulley 138 is connected that, as shown in FIG. 1, is arranged above he corresponding drum 18 and is maintained suspended through the third cable 137, so that the second cable 134 exchanges power between the interfaces 132 and the shaft 10. A second pulley 139 is carried by the second bearing portion 114 in association with each respective interface 132 to vary progressively, in use, the load acting on the second cable 134 as the inclination of each interface 132 varies.

In view of the above description, and without however limiting the protective scope of the present invention, the gymnastic machine 100 is designed to allow a user to train the shoulders acting against the action of the load group 120 analogously to the so-called "shoulder presses". The machine 100 is therefore provided with a support member 116, shown only in FIG. 1, for a user supported by the second bearing portion 114 that, in this particular embodiment, is constituted by a seat.

The use of the functional group 1 and of the machine 100 embodying it is easily understood from the description above and does not require further explanations.

However it should be specified that, in view of the above description, once the type of machines has been identified that will constitute a given product line, for instance, although without limitation, machines for push/pull training the pectorals, the triceps, and the back muscles, it will be possible to design structurally similar second bearing portions 114 and provide them with a plurality of holes 111 arranged so that they can be coupled to first and second bars 172/174 of shape definable at will, to allow the frame 110 to be completed with substantially identical first bearing portions 112. This allows to limit the variants of the single components of the machines of a same line, and it is therefore possible to say that to each line of machines corresponds a family of frames 110, all comprising load groups 120 and actuating groups 130 substantially identical, at least as regards the respective coupling portions. Therefore, these frames 110, and hence the machines composing the same line, are of the modular type.

Lastly, it is apparent that modifications and variants can be made to the functional group 1 and to the machine 100 described and illustrated herein, without however departing from the protective scope of the present invention.

Figure 6:
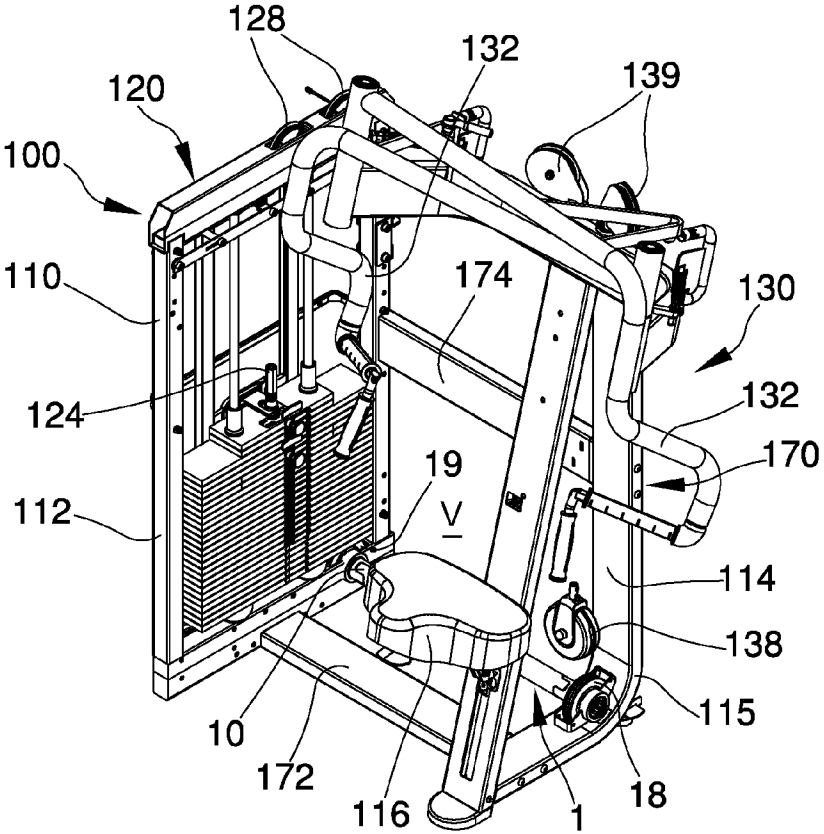
FIG. 6 shows a schematic perspective view of a second preferred embodiment of FIG. 1.

For instance, with reference to FIG. 6, another constructive type is shown of the machine 100, usable for training the pectorals and generally identified as "chest press".

In view of the above description it is clearly apparent that the machine 100 and the respective torsion transmission group 1 solve the problem of standardizing the structure of the frame and of the groups composing the weight stack machines, allowing to produce separately the actuating group 130 and the load group 120, that can be produced in a substantially standardized manner to simplify the production phases of the machine 100 in its entirety and therefore to reduce the investments necessary to manage the bills of materials of the two groups, the warehouse of the component and/or semi-assembled parts and to facilitate their assembling, transport, and installation, in order to create the conditions for a significant increase in the market and the sale volumes of products reliable and easy to be used. Therefore, the identification of a functional group 1 provided with a modular torsion shaft 10, with standardised torsion interfaces constituted by the lateral portions 14 and 15, allows to construct a standard module M, shown in FIG. 4, comprising the load group 120 and the functional group 1, to be used in all the machines of a line of weight stack gymnastic machines. This allows to define the type of each single gymnastic machine 1, only typing the actuating group 130, that will be specifically provided to involve a given muscular region every time according to the actual level of orders, with a clear economic advantage. This allows to construct gymnastic machines provided with actuating groups very different from one another using standard load groups, already available at warehouse and in any case constructed before and/or in a different plant, that can be very distant from where the actuating group 130 has been constructed. It is easily understood that this allows to subdivide the production so as to manage it at a double speed, maintaining the part related to the load group 120 separated from that of the actuating group 130; in this way it is possible to benefit from a more effective scale economy than the ordinary one, linked to a given type of a gymnastic machine composing a same line. It is also clearly apparent that this choice allows the company to adjust the production scheduling in very limited times; in fact, to produce a single machine it will be possible to focus every time only on the production of given actuating groups.

Furthermore, the insertion of a torsion shaft 10 in the transmission chain between the actuating group 130 and the load group 120 improves the fluency in the operation of the machine 100, both when used under full load and minimum load for executing fast and quick exercises, by comparison with the machines where the power transmission occurs only through cable-pulleys pairs. With the same fluency in operation perceived by a user, the use of a torsion transmission member in the functional group 1 allows to reduce the costs for the equipment necessary for ensuring a good alignment of the planes of the grooves of the numerous pulleys carried adjacent to one another by frames of weight stack machines constructed by coupling bars with the metal carpentry technique. Furthermore, reducing the extension of the cables usable to interact with the load, and eliminating the cables at floor level makes these machines much safer than the machines where the power transmission occurs only thanks to the use of cables and pulleys. The function group 1 can be therefore interpreted as a safety transmission group, which is particularly easy to be adapted according to the needs simply by adapting the extension of the central portion, and is therefore easy to be installed, effective and economical.

What is claimed is:

1. A functional group for a gymnastic machine provided with a frame supporting a load group usable for executing a gymnastic exercise using a first cable; said machine comprising an actuating group provided with at least one user interface carried movably by said frame and with an actuating second cable mechanically connected with said load group by means of said first cable; said functional group comprising a modular transmission member arranged between said user interface and said load group to exchange power between said first and second cables so as to facilitate packaging, assembling and disassembling said frame; wherein said transmission member comprises a torsion shaft extending along a given direction and comprising a central portion axially delimited by two lateral portions, each of which supports a drum coupled to said frame in a freely rotatable and axially fixed manner through a mechanical connecting device to wind said first and/or second cable; wherein each of said lateral portions includes an end portion of a given shape and each of said connecting devices includes a removable head provided with a coupling member shaped in a conjugated manner with said end portion to shape-couple and allow the exchange of a torque through said central portion.

2. The group according to claim 1, wherein each of said connecting device comprises two coupling mechanical elements of substantially conjugated shape and longitudinally interpenetrated to transmit torque stresses between the at least one said interface and said load group.

3. A gymnastic machine comprising a frame supporting a load group usable for executing an exercise and an actuating group provided with at least one user interface carried movable by said frame to exchange power with said load group; characterized in that said actuating group and said load group are distinct from each other; a functional group comprising a transmission member arranged between said actuating group and said load group to interface them with each other mechanically so as to simplify the construction of said frame and to guarantee an effective exchange of torque between said actuating group and said load group; wherein said transmission member comprises a torsion shaft extending along a given direction and comprising a central portion axially delimited by two lateral portions, each of which support a drum coupled to said frame in a freely rotatable and axially fixed manner through a mechanical connecting device to wind said first and/or second cable; wherein each of said lateral portions includes an end portion of a given shape and each of said connecting devices includes a removable head provided with a coupling member shaped in a conjugated manner with said end portion to shape-couple and allow the exchange of a torque through said central portion.

4. The machine according to claim 3, wherein said frame is of the modular type and includes a first bearing portion designed to support said load group and a second bearing portion designed to support said actuating group; said frame comprising a coupling means for stably connecting said first and second bearing portions; said actuating group comprising a first cable wound around at least said drum; said load group being provided with a plurality of bricks put over one another transversally to said shaft, with a rod suitable to collect said bricks selectively and removably transfer to said given direction, and with a second cable wound around a plurality of first pulleys carried by said frame; said second cable being connected with said rod to move said bricks along said given direction.

5. The machine according to claim 4, wherein said coupling means comprises a base bar and an intermediate connecting bar, which are arranged between said first and second bearing portions parallel to said shaft and transversally both to said first bearing portion and to said second bearing portion of said frame; said base bar delimited at the bottom of said frame and being arranged between bases of said first and second bearing portions, said second bar being arranged in an intermediate position for said load group; said base bar being arranged adjacent to said shaft and said second bearing portion being designed to carry said drum to position said shaft at a base height for said frame so as to maximize a training free volume.

6. The machine according to claim 5, wherein said second bearing portion supports a pair of interfaces pivoted symmetrically relative to a median plane (M) arranged transversally to said shaft.

7. The machine according to claim 5, wherein said first bearing portion carries the corresponding said drum at opposite sides from said second bearing portion; said actuating group comprising a third cable provided with respective ends integrally connected with said interfaces.

8. The machine according to claim 7, wherein said first cable is connected to a floating pulley at opposite sides from the corresponding said drum; said third cable being wound centrally around said floating pulley to transmit power between said interfaces and said shaft; a second pulley being carried by said second bearing portion in association with each respective interface to vary progressively, in use, the load acting on said first cable as the inclination of each said interface varies.

9. The machine according to claim 4, wherein said second bearing portion is provided with a support member for supporting a user.

10. The machine according to claim 9, wherein said support member comprises a seat.

* * * * *